US006652348B2

(12) United States Patent
Yen

(10) Patent No.: US 6,652,348 B2
(45) Date of Patent: Nov. 25, 2003

(54) AQUATIC MOTION DISPLAY TOY

(76) Inventor: Jen-Yen Yen, No. 22-1, Lane 3, Haochin Rd., Nanhsin Tsun, Yenpu Hsiang, Changhua County (TW)

( * ) Notice: Subject to any disclaimer, the term of this patent is extended or adjusted under 35 U.S.C. 154(b) by 47 days.

(21) Appl. No.: 10/045,139

(22) Filed: Jan. 15, 2002

(65) Prior Publication Data

US 2003/0134564 A1 Jul. 17, 2003

(51) Int. Cl.[7] ..... A63H 23/00; B05B 17/08
(52) U.S. Cl. ..... 446/158; 446/159; 239/17
(58) Field of Search ..... 446/153, 154, 446/159, 176, 267, 158; 239/16, 17, 18, 19, 20; 40/406, 407, 409

(56) References Cited

U.S. PATENT DOCUMENTS 3,773,258 A * 11/1973 Hruby, Jr. ..... 239/17
4,890,838 A * 1/1990 Rudell et al. ..... 273/138.1
4,892,250 A * 1/1990 Fuller et al. ..... 239/18
5,127,366 A * 7/1992 Kim ..... 119/246
5,862,984 A * 1/1999 Chang ..... 239/17
6,375,090 B1 * 4/2002 Beidokhti ..... 239/17
6,505,782 B1 * 1/2003 Yen ..... 239/17

* cited by examiner

*Primary Examiner*—Derris H. Banks
*Assistant Examiner*—Faye Francis

(57) ABSTRACT

An aquatic motion display toy is constructed to include a hollow holder base, a water pump, a bottom panel, an upper panel, a transparent face panel, and a splasher. The bottom panel, the upper panel, and the face panel are press-fitted into one another, defining a plurality of concentrically disposed annular water accumulation chambers such that water is accumulated in the water accumulation chambers and then forced out of corresponding jet nozzles at the face panel during running of the water pump. LEDs are provided in the upper panel and controlled to emit light toward fallen water during running of the water pump.

6 Claims, 4 Drawing Sheets

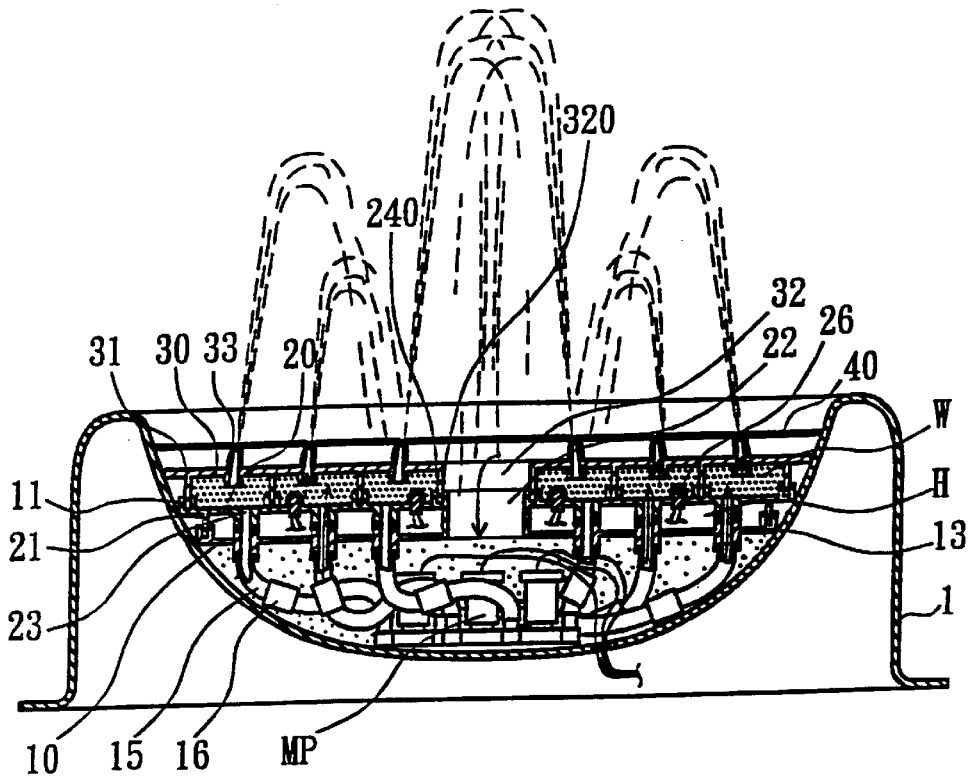
FIG. 3
FIG. 4 A
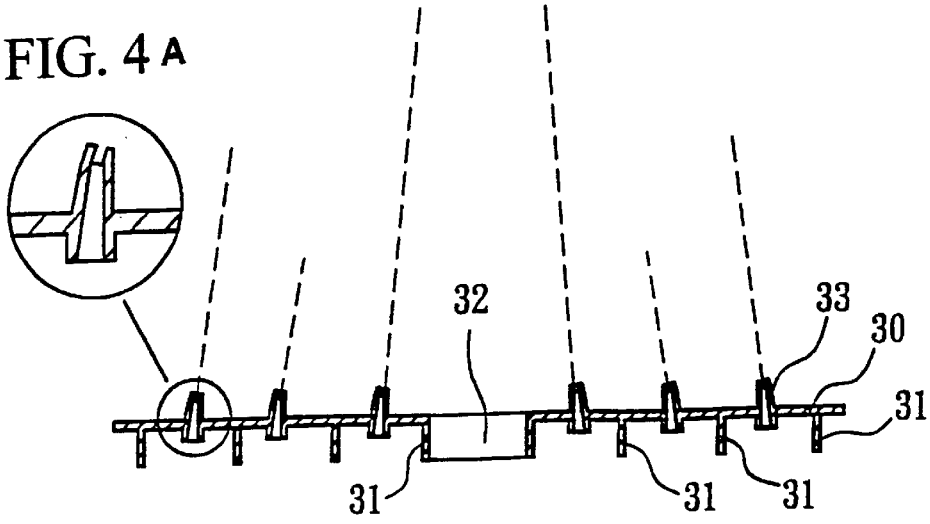
FIG. 4

AQUATIC MOTION DISPLAY TOY

BACKGROUND OF THE INVENTION

1. Field of the Invention

The present invention relates to display toys and, more particularly, to an aquatic motion display toy.

2. Description of the Related Art

Various aquatic motion display toys are commercially available. However, these aquatic motion display toys are commonly heavy and expensive. The maintenance work of the conventional aquatic motion display toys is also complicated because the user cannot easily detach the parts. Furthermore, when water falls from the high place, it may be plashed on to the surroundings.

SUMMARY OF THE INVENTION

The present invention has been accomplished under the circumstances in view. It is one object of the present invention to provide an aquatic motion display toy, which is inexpensive to manufacture and easy to maintain. It is another object of the present invention to provide an aquatic motion display toy, which has a compact structure. It is still another object of the present invention to provide an aquatic motion display toy, which prevents fallen water from splashing. It is still another object of the present invention to provide an aquatic motion display toy, which produces an attractive pattern of waterfall. It is still another object of the present invention to provide an aquatic motion display toy, which produces a lighting effect during generating of an attractive pattern of waterfall. According to one aspect of the present invention, the aquatic motion display toy is comprised of a hollow holder base holding an amount of water, a bottom panel fixedly mounted in the hollow holder base, an upper panel mounted in the hollow holder base above the bottom panel, a water pump adapted to pump water from the hollow holder base to water outlet pipes in the bottom panel and the upper panel, a transparent face panel mounted in the hollow holder base above the upper panel and defining with the upper panel a plurality of concentrically disposed annular water accumulation chambers, the face panel having a plurality of jet nozzles for output of water from the water accumulation chamber, and a splasher mounted in the holder base above the face panel for preventing splashing of fallen water. According to another aspect of the present invention, LEDs are provided in the upper panel and controlled to emit light toward fallen water during running of the water pump. According to still another aspect of the present invention, the upper panel comprises an annular bottom coupling flange press-fitted into an annular top coupling groove of the bottom panel, and a plurality of concentrically disposed annular top coupling grooves. The face panel comprises a plurality of annular bottom coupling flanges respectively press-fitted into the annular top coupling grooves of the upper panel, defining with the upper panel the aforesaid annular water accumulation chambers. According to still another aspect of the present invention, the jet nozzles of the face panel are tilted in direction toward the central axis passing through the center of the face panel.

BRIEF DESCRIPTION OF THE DRAWINGS

FIG. 3 is a sectional view of the present invention showing the aquatic motion display toy in function.

FIG. 4 is a schematic drawing showing the water ejecting angle of the jet nozzles of the face panel for the aquatic motion display toy according to the present invention.

FIG. 4A is an enlarged view of a part of FIG. 4.

DETAILED DESCRIPTION OF THE PREFERRED EMBODIMENT

Figure 1:
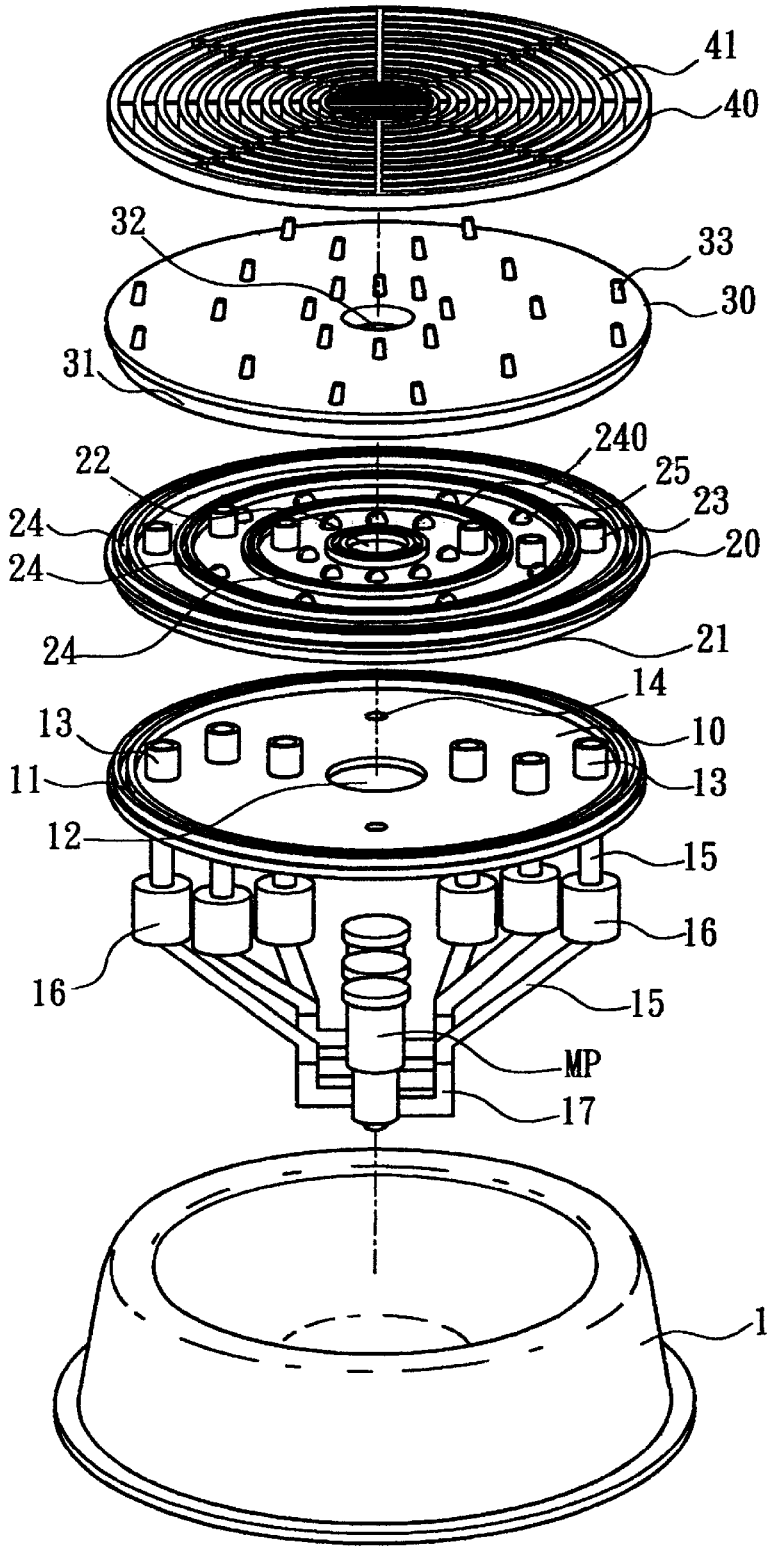
FIG. 1 is an exploded view of an aquatic motion display toy constructed according to the present invention.
Figure 2:
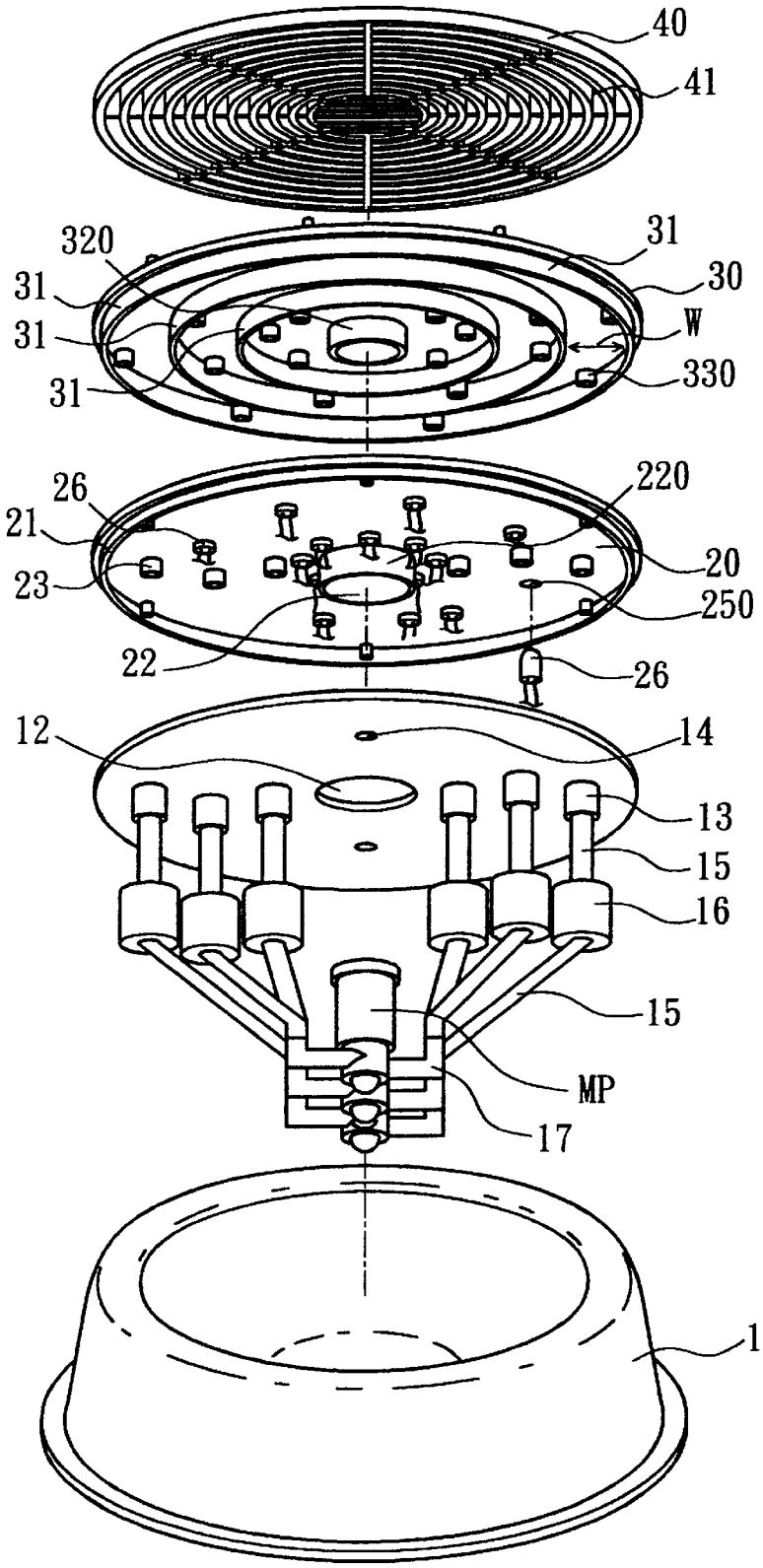
FIG. 2 is another exploded view of the aquatic motion display toy when viewed from another angle according to the present invention.

Referring to FIGS. from 1 through 4, an aquatic motion display toy in accordance with the present invention is generally comprised of a hollow holder base 1, a water pump MP, a bottom panel 10, an upper panel 20, a face panel 30, and a splasher 40.

The water pump MP is mounted in the hollow holder base 1. The bottom panel 10 is fixedly mounted in the hollow holder base 1 above the water pump MP, comprising a plurality of vertically extended water outlet pipes 13 respectively connected to the output port 17 of the water pump MP by a respective hose 15, a center water hole 12 for enabling water to flow backwards from the space above the bottom panel 10 to the inside of the hollow holder base 1 below the bottom panel 10, a plurality of wire holes 14 for the passing of electric wires, and an annular top coupling groove 11 disposed at the top side around the border. Further, a check valve 16 is respectively installed in each hose 15 to prohibit reverse flow of water.

The upper panel 20 is made of light permeable plastics and fixedly mounted in the hollow holder base 1 and spaced above the bottom panel 10, comprising a center water hole 22 for enabling water to flow backwards from the space above the upper panel 10 to the inside of the hollow holder base i below the bottom panel 10, a plurality of vertical water outlet pipes 23 respectively connected to the water outlet pipes 13 of the bottom panel 10, a center coupling stub tube 220 downwardly protruded from the bottom sidewall around the center water hole 22 and press-fitted into the center water hole 22 of the bottom panel 10, an annular bottom coupling flange 21 press-fitted into the annular top coupling groove 11 of the bottom panel 10, a plurality of LED holes 250, a plurality of LEDs (light emitting diodes) 26 respectively mounted in the LED holes 250, a plurality of rounded transparent shades 25 respectively covered on the LED holes 250 over the LEDs 26 at the top side, and a plurality of annular top coupling grooves 24 and 240 of different diameters concentrically disposed in the top sidewall. The electric wires of the LEDs 26 are extended through the wire holes 14 of the bottom panel 10, and then gathered together and extended through a bottom wire hole (not shown) to the bottom side of the hollow holder base 1 for connection to power source.

The face panel 30 is made of transparent plastics and fixedly mounted in the hollow holder base 1 above the upper panel 20, comprising a center water hole 32 for enabling water to flow backwards from the space above the face panel 30 to the inside of the hollow holder base 1 below the bottom panel 10, a stub center tube 320 downwardly protruded from the bottom sidewall around the center water hole 32 and press-fitted into the center coupling stub tube 220 of the upper panel 20 for guiding water from the space above the face panel 30 to the space below the bottom panel 10, a plurality of annular bottom coupling flanges 31 of different diameters protruded from the bottom sidewall around the stub center tube 320 and respectively press-fitted into the annular top coupling grooves 24 and 240 of the upper panel 20, and a plurality of jet nozzles 33. After installation of the face panel 30 in the hollow holder base 1, the annular bottom coupling flanges 31 define with the bottom sidewall of the face panel 30 and the top sidewall of the upper panel 20 a plurality of annular water accumulation chambers W where water from the water outlet pipes 23 is accumulated and then forced out of the jet nozzles 33. Preferably, the jet nozzles 33 are tilted in direction toward the central axis passing through the center of the face panel 30.

The splasher 40 is fixedly mounted in the hollow holder base 1 above the face panel 30, having a plurality of openings 41 for buffering fallen water.

Referring to FIG. 3 again, the hollow holder base 1 holds a certain amount of water below the bottom panel 10. The water pump MP is a submerged pump that pumps water from the hollow holder base 1 to the hoses 15 and then the water outlet pipes 13 and 23 and then into the water accumulation chambers W. When sufficient water pressure is produced in the water accumulation chambers W, water is forced out of the jet nozzles 33, showing a pattern of waterfall. Fallen water is then guided through the stub center tube 320 of the face panel 30 and the stub center tube 220 of the upper panel 20 to the inside of the hollow holder base 1. During the operation of the water pump MP, the LEDs 26 are driven to emit light, producing a lighting effect.

Figure 5:
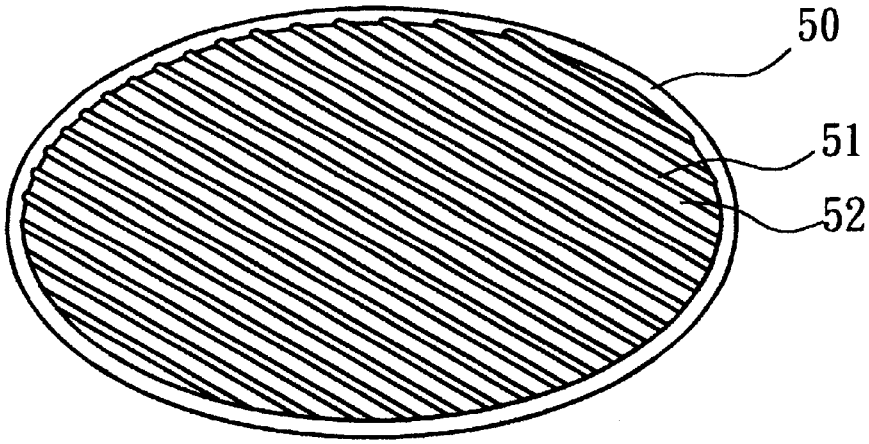
FIG. 5 is an elevational view of an alternate form of the splasher for the aquatic motion display toy according to the present invention.

FIG. 5 shows an alternate form of the splasher. According to this alternate form, the splasher is formed of a plurality of parallel wire rods 51 connected to one another, defining a plurality of narrow, elongated, parallel openings 52.

Figure 6:
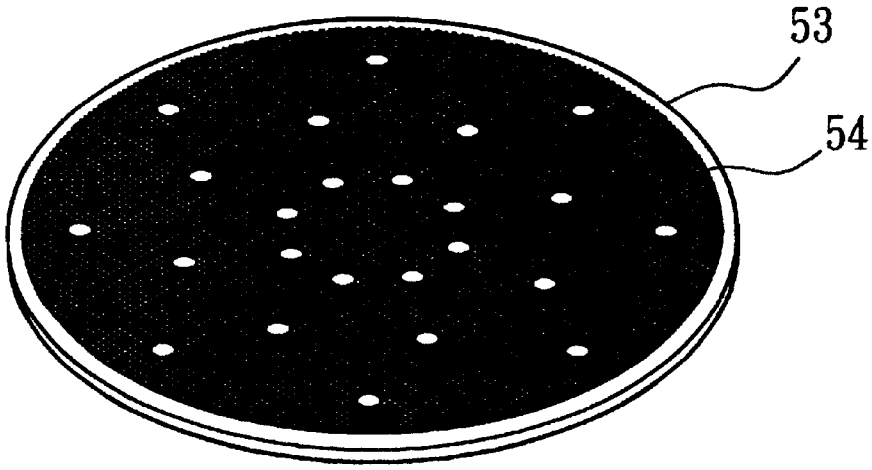
FIG. 6 is an elevational view of another alternate form of the splasher for the aquatic motion display toy according to the present invention.

FIG. 6 shows another alternate form of the splasher. According to this alternate form, the splasher 53 is comprised of a wire gauze filter 54.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An aquatic motion display toy comprising:

a hollow holder base holding an amount of water;

a water pump mounted in said hollow holder base and adapted to pump water from said hollow holder base to a water output port thereof;

a bottom panel fixedly mounted in said hollow holder base above said water pump, said bottom panel comprising a plurality of vertically extended water outlet pipes respectively connected to the water output port of said water pump, and a center water hole for enabling water to flow backwards from a space above said bottom panel to the inside of said hollow holder base below said bottom panel;

an upper panel made of light permeable plastics and fixedly mounted in said hollow holder base above said bottom panel, said upper panel comprising a plurality of vertical water outlet pipes respectively connected to the water outlet pipes of said bottom panel, and a center coupling stub tube press-fitted into the center water hole of said bottom panel for guiding water from the space above said upper panel to the inside of said hollow holder base below said bottom panel; and a face panel made of transparent plastics and fixedly mounted in said hollow holder base above said upper panel, said face panel comprising a stub center tube press-fitted into the center coupling stub tube of said upper panel for guiding water from the space above said face panel to the inside of said hollow holder base below said bottom panel, and a plurality of jet nozzles for output of water from water accumulation chambers to the space above said face panel;

wherein a splasher fixedly is mounted in said hollow holder base above said face panel for buffering fallen water.

2. The aquatic motion display toy as claimed in claim 1, wherein:

said bottom panel comprises an annular top coupling groove disposed in a top sidewall thereof around the border;

said upper panel comprises an annular bottom coupling flange protruded from a bottom sidewall thereof around the border and press-fitted into the annular top coupling groove of said bottom panel, a plurality of LED holes, a plurality of LEDs (light emitting diodes) respectively mounted in said LED holes, a plurality of rounded transparent shades respectively covered on said LED holes over said LEDs, and a plurality of annular top coupling grooves of different diameters concentrically disposed in a top sidewall thereof;

said face panel comprises a plurality of annular bottom coupling flanges of different diameters concentrically protruded from a bottom sidewall thereof and respectively press-fitted into the annular top coupling grooves of said upper panel and defining with said upper panel said water accumulation chambers.

3. The aquatic motion display toy as claimed in claim 1, wherein said splasher is formed of a wire gauze filter.

4. The aquatic motion display toy as claimed in claim 1, wherein said splasher is a grille.

5. The aquatic motion display toy as claimed in claim 1, further comprising a plurality of hoses respectively connected between the water output port of said water pump and the water outlet pipes of said bottom panel, and a plurality of check valves respectively installed in said hoses to prohibit reverse flow of water.

6. The aquatic motion display toy as claimed in claim 1, wherein said jet nozzles are tilted in direction toward the central axis passing through the center of said face panel.

* * * * *